US006848231B2

(12) United States Patent
Kepler et al.

(10) Patent No.: US 6,848,231 B2
(45) Date of Patent: Feb. 1, 2005

(54) METHOD FOR REINFORCING WOODEN STRUCTURAL ELEMENTS USING A REINFORCEMENT MEMBER

(75) Inventors: William F. Kepler, Golden, CO (US); Erin K. Gleason, Boulder, CO (US)

(73) Assignee: The United States of America as represented by the Department of the Interior, Bureau of Reclamation, Washington, DC (US)

( * ) Notice: Subject to any disclaimer, the term of this patent is extended or adjusted under 35 U.S.C. 154(b) by 0 days.

(21) Appl. No.: 10/366,332

(22) Filed: Feb. 14, 2003

(65) Prior Publication Data

US 2004/0159072 A1 Aug. 19, 2004

(51) Int. Cl.[7] ..... E04C 2/52; E04B 1/00

(52) U.S. Cl. ..... 52/741.1; 52/702; 52/713; 52/220.8

(58) Field of Search ..... 52/702, 713–715, 52/514, 220.1, 220.8; 403/232.1; 248/49, 57, 65, 72, 56

(56) References Cited

U.S. PATENT DOCUMENTS 3,034,185 A * 5/1962 Olsen ..... 403/347
4,050,205 A * 9/1977 Ligda ..... 52/357
4,924,646 A * 5/1990 Marquardt ..... 52/220.1
5,501,054 A 3/1996 Soltis et al.
5,678,381 A 10/1997 DenAdel
5,992,125 A 11/1999 Hardy
6,176,057 B1 * 1/2001 Bouchet et al. ..... 52/514
6,176,058 B1 1/2001 Trarup
6,363,682 B1 4/2002 Cowley
D483,651 S * 12/2003 Sander ..... D8/349
6,671,974 B2 * 1/2004 Polk, Jr. ..... 33/562

* cited by examiner

*Primary Examiner*—Peter M. Cuomo
*Assistant Examiner*—Stephen D'Adamo
(74) *Attorney, Agent, or Firm*—Stites & Harbison PLLC; Ross F. Hunt, Jr.

(57) ABSTRACT

A method is provided for enabling an infrastructure, such as pipework or a bundle of electrical cables, to be passed directly through a wooden structural element without significantly weakening the structural element, rather than being routed around the structural element. A throughhole is provided in the structural element which extends between opposed sides. The method includes affixing to the wooden structural element a unitary reinforcement member including two spaced, parallel side plates joined together by a support plate. Each of the side plates has an opening therein as large as or larger than the throughhole. The reinforcement member is affixed to the wooden structural element by securing one of the side plates to each side of the structural element, with the opening of each of the side plates disposed so as to surround the throughhole. The side plates each include a pattern of fastener apertures and a plurality of fasteners penetrate through the fastener apertures into the wooden structural element so as to secure the reinforcement member in place.

13 Claims, 2 Drawing Sheets

METHOD FOR REINFORCING WOODEN STRUCTURAL ELEMENTS USING A REINFORCEMENT MEMBER

FIELD OF THE INVENTION

The present invention relates to reinforcement members for wooden structural elements and, more particularly, to a method for reinforcing such a wooden structural element using a metal reinforcement member for the wooden structural element which permits passage of a large electrical and/or mechanical infrastructure through the wooden structural element without reducing the load carrying capacity thereof.

BACKGROUND OF THE INVENTION

In accordance with current practice, large electrical and/or mechanical infrastructures such as mechanical piping, electrical cable bundles and the like, must be routed around wooden structural elements such as wooden support beams. The chief reason for this is that going directly through such wooden structural elements reduces the load carrying capability of the structural elements. In practice, where holes are drilled in a structural element, only small holes are drilled, e.g., holes having a diameter that is about ⅙ of the thickness or depth of the wooden structural elements. This, of course, limits the size of the infrastructure that can be routed directly through such wooden structural elements. However, routing of such infrastructures around the wooden structural elements, rather than through the elements can produce functional problems and the result is often unpleasant from an aesthetic viewpoint.

Various forms of reinforcement members are known per se. U.S. Pat. No. 6,363,682 B1 to Cowely relates to structural "enhancers" for rectangular beams of lumber which are subjected to severe torsional forces. The structural enhancer includes a thin web portion which engages the bight of the beam and which has "punchout" areas for nailing and/or conduit penetration. U.S. Pat. No. 5,678,381 to DenAdel discloses an insulated beam including two metal support channels which wrap partially around a plastic block member. Vertical ribs are provided in the area of an aperture which is used to provide access between the exterior and interior of the block member. U.S. Pat. No. 5,501,054 to Soltis et al discloses a reinforced wooden structural member wherein a wooden substrate is bonded to a reinforcing material in sandwich-like configuration in areas of anticipated bolted connections extending through the structural member, and wherein an aperture is provided in the reinforced structural member for this purpose. U.S. Pat. No. 5,992,125 to Hardy discloses a brace structure including a top plate of a wood-frame structure, with first and second vertically oriented plates on opposite sides of the top plate and a utility access hole in the top plate. U.S. Pat. No. 6,176,058B1 to Trarup discloses a reinforcing member for an end-splint wood beam.

SUMMARY OF THE INVENTION

In accordance with the invention, a method is provided which uses a metal support and reinforcement member or system that permits a large throughhole to be cut through, or otherwise provided in, a wooden structural element so as to enable the passage through the throughhole, and thus through the structural element, of a large electrical and/or mechanical infrastructure, without reducing the load carrying capacity of the structural element. The metal support and reinforcement system can carry all loads across the throughhole and different embodiments thereof can carry different combinations of axial, shear and moment forces.

In accordance with a first aspect of the invention, there is provided a method for enabling passage of an elongate infrastructure through a wooden structural element without substantially weakening the structural element or reducing the load carrying capacity thereof, the method comprising:

providing a wooden structural element having opposed sides and including a throughhole extending through the wooden structural element between the opposed sides; and affixing to the wooden structural element a unitary reinforcement member comprising first and second spaced side plates joined together by a support plate and each having an opening therein at least as large as the throughhole;

the affixing of the reinforcement member to the wooden structural element comprising securing one of each of the side plates to a respective one of the opposed sides of the structural element with the opening of each of the side plates disposed so as to surround the throughhole.

Preferably, the side plates each include a pattern of fastener apertures and the securing of said side plates to the wooden structural element comprises affixing the side plates to the opposed sides of said wooden structural element using a plurality of fasteners which penetrate into the wooden structural element through the fastener apertures so as to secure the reinforcement member in place on the wooden structural element.

Advantageously, the fasteners comprise mechanical fasteners selected from the group consisting of nails, screws and bolts.

In one preferred embodiment, said pattern of fastener apertures includes at least one row of apertures on each side of said opening.

Preferably, the fastener apertures of the first plate are offset from the fastener apertures of the second plate.

In one preferred implementation, the support plate is of a thickness greater than that of the side plates. Further, the support plate advantageously extends laterally outwardly of plates on opposite sides thereof.

In one advantageous embodiment, the opening in each of the side plates is of a trapezoidal shape.

In accordance with a further aspect of the invention, there is provided a method for enabling passage of an elongate infrastructure through a wooden structural element so that the infrastructure extends completely through the structural element, without substantially weakening the structural element or reducing the load carrying capacity thereof, the method comprising:

providing a wooden structural element having opposed sides;

removing a portion of the wooden structural element so as to create a throughhole extending through the wooden structural element between the opposed sides thereof; and reinforcing the wooden structural element using a reinforcement member comprising first and second spaced, parallel, reinforcing plates joined together at one edge thereof by a support plate and each having an opening therein larger than the throughhole;

the support plate being brought into abutment with a surface of the wooden structural element between the opposed sides and the reinforcing plates each being secured to one of said opposed sides of said structural element with the opening of each of the reinforcing plates disposed so as to surround the throughhole;

the reinforcing plates each including a pattern of fastener apertures and the securing of the reinforcing plates to the wooden structural element comprising affixing the reinforcing plates to the opposed sides of the wooden structural element using a plurality of fasteners which penetrate into the wooden structural element through the fastener apertures so as to secure the reinforcement member in place on the wooden structural element; and the method further comprising inserting an elongate infrastructure through the throughhole.

As indicated above, the elongate infrastructure can comprise, for example, a pipe member, or a bundle of electrical cables.

Further features and advantages of the present invention will be set forth in, or apparent from, the detailed description of preferred embodiments thereof which follows.

DESCRIPTION OF THE PREFERRED EMBODIMENTS

Figure 1:
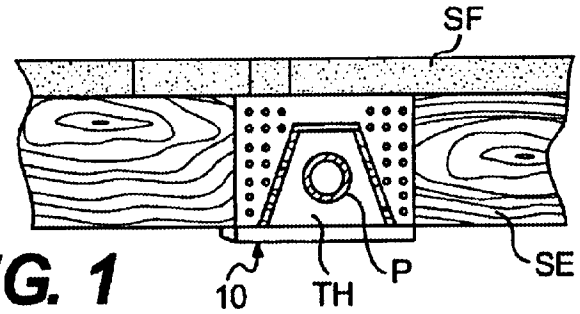
FIG. 1 is a schematic front elevational view of a wooden frame construction including a wooden structural element incorporating a support and reinforcement system in accordance with the invention.

Referring to FIG. 1, there is shown an exemplary wooden structure S incorporating a reinforcement member which is generally denoted 10 and which is constructed in accordance with a preferred embodiment of the invention. In this embodiment, the wooden structure S is a conventional floor construction and includes a subflooring member SF supported by a wooden structural element or joist SE. A throughhole or opening TH in joist SE permits passage of a pipe P therethrough. It will be appreciated that a plurality of such joists SE would be provided to support the subflooring SF and that aligned openings TH would be provided in each of the joists. It is to be understood that the construction of the wooden structure S is merely exemplary and that the invention is, of course, applicable to other, different arrangements and configurations.

Figure 2:
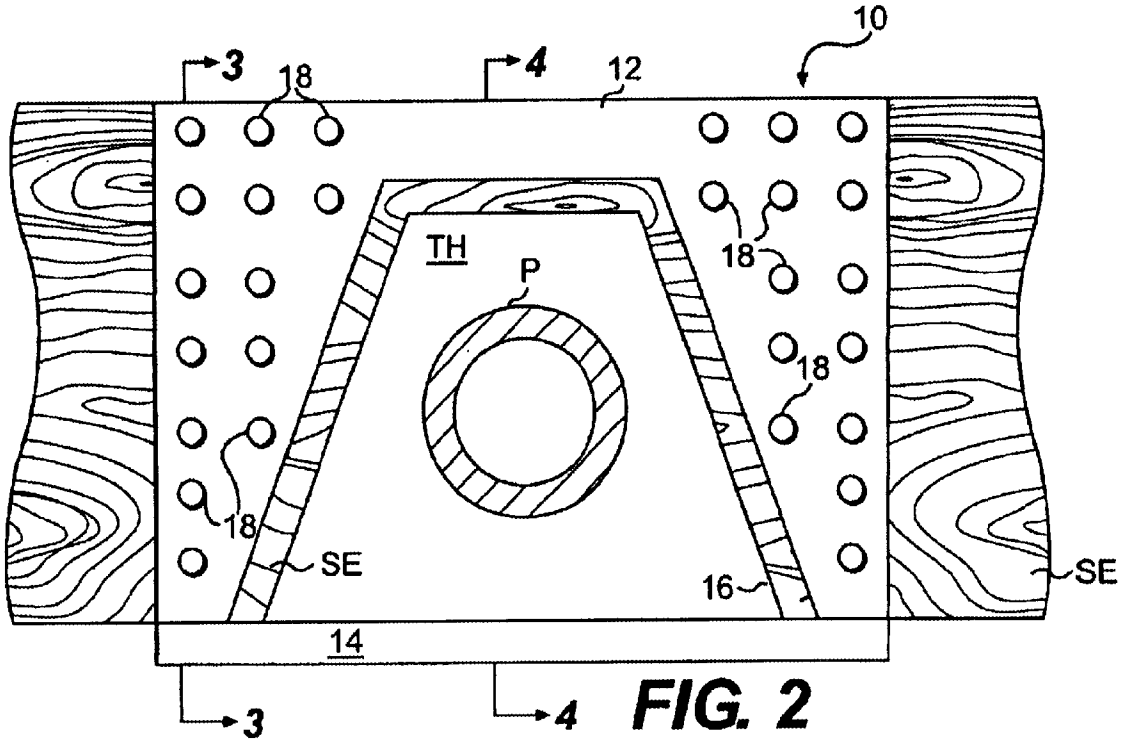
FIG. 2 is a front elevational view of the support and reinforcement system of FIG. 1, in accordance with a preferred embodiment thereof.
Figure 4:
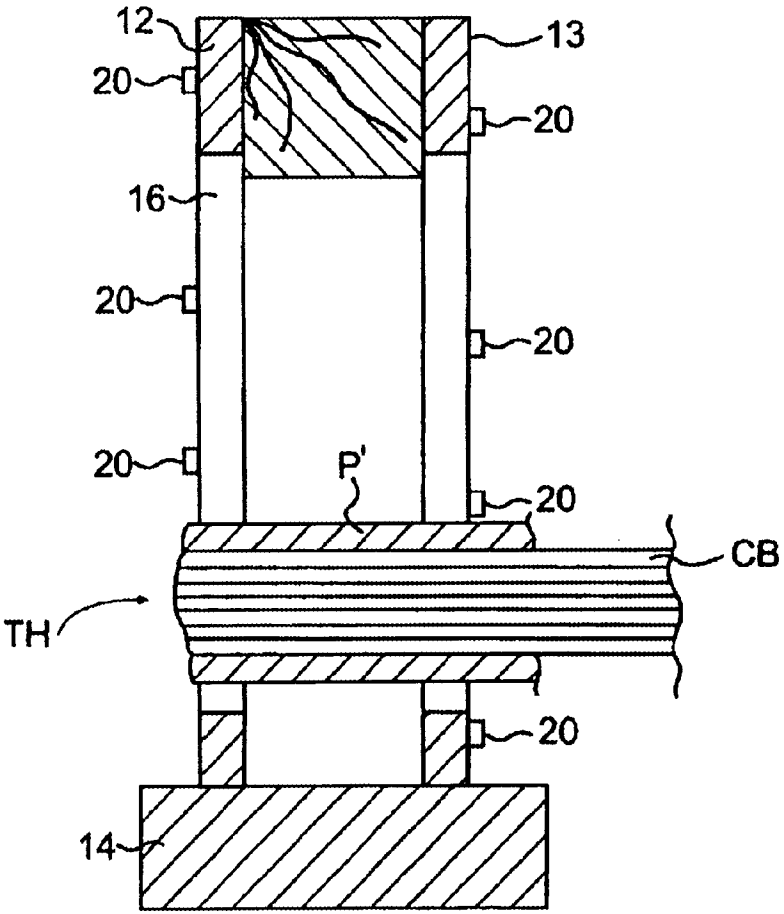
FIGS. 3 and 4 are cross sectional views, taken generally along lines A—A and B—B of FIG. 2, of an embodiment similar to that of FIG. 2.
Figure 3:
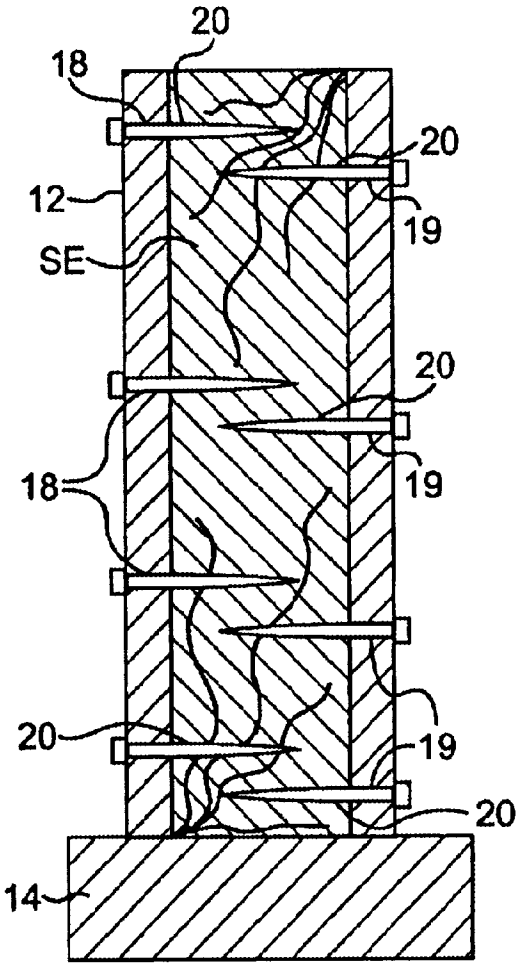

Referring to FIG. 2 and FIGS. 3 and 4, there is shown an exemplary embodiment of reinforcement member 10. Referring first to FIG. 2, a first side plate 12 and a bottom plate 14 of member 10 are shown. As illustrated, side plate 12 is generally of an inverted U-shaped configuration although plate 12 can be of other shapes or configurations.

Side plate 12 includes an aperture 16 of a generally trapezoidal shape, although, again, other shapes can be employed. Aperture 16 is designed to be disposed around, i.e., to surround, the throughhole TH which extends through structural element SE and through which extends pipe P. Pipe P is an example of an infrastructure of the type discussed above and, as indicated previously, the invention can be used to enable accommodation of the penetration through a wooden structural element, such as element SE, of a mechanical and/or infrastructure such as a cable bundle, pipework and the like.

Side plate 12 also includes a plurality of fastener holes 18 therein which enable fasteners such as nails, screws, bolts or the like to be driven into or otherwise caused to penetrate structural element SE and thus secure reinforcement member 10 to structural element SE. Fastener holes 18 are advantageously arranged in a symmetrical pattern with respect to aperture 16 and, in an exemplary embodiment which is not illustrated, side plate 12 is made wider and three vertical rows of five holes 18 can be provided on each side. However, it will, of course, be appreciated that the pattern of fastener holes 18 will vary depending on the application.

As shown in FIGS. 3 and 4, reinforcement member 10 includes a second parallel side plate 13 disposed in spaced relation to plate 12 and supported on and affixed to the bottom plate 14. FIGS. 3 and 4 are cross sections taken generally along line A—A and line B—B, respectively, but these figures show a slightly different embodiment of reinforcement member 10 wherein bottom plate 14 is thicker than is shown in FIG. 2 and the number of fastener holes 18 is reduced. As illustrated, bottom plate 14 also extends laterally outwardly on both sides of plates 12 and 13 in this embodiment. It will be understood that the thickness and shape of bottom member 14 can also be varied depending on the application and the forces to be withstood, e.g., axial, shear and moment forces and combinations thereof.

As best seen in FIG. 4, the fastener holes 19 in plate 13 are offset from fastener holes 18 in plate 12 so that fasteners 20 (shown in this exemplary embodiment as nails) are also offset and can penetrate sufficiently into structural element SE to provide secure engagement of reinforcement member 10 with structural element SE. Of course, if fasteners 20 are bolts (not shown), the fastener holes 19 would be aligned.

As indicated above, and illustrated in FIG. 4, the infrastructure that extends through structural element SE may also comprise a cable bundle CB. Further, although a pipe P' is also shown in FIG. 4, which functions in this embodiment as a protective sleeve for cable bundle CB, the cable bundle may be otherwise supported.

As set forth above, and should be evident from the foregoing, the support and reinforcement member 10 can be constructed to carry any load across the throughhole TH and, as was also indicated above, different embodiments can carry different combinations of axial, shear and moment forces.

The reinforcement member is preferably made of steel although other metals can, of course, be used and, in some cases, depending on the application, a hard plastic or other material can be employed.

Although the invention has been described above in relation to preferred embodiments thereof, it will be understood by those skilled in the art that variations and modifications can be effected in these preferred embodiments without departing from the scope and spirit of the invention.

What is claimed is:

1. A method for enabling passage of an elongate infrastructure through a wooden structural element, said method comprising:

providing a wooden structural element having opposed sides and including a throughhole extending through the wooden structural element between said opposed sides; and affixing to said wooden structural element a unitary reinforcement member comprising first and second spaced side plates joined together by a support plate and each having an opening therein at least as large as said throughhole, said support plate being of a thickness greater than that of said side plates, and said support plate extending laterally outwardly from said side plates at opposite sides thereof;

said affixing of said reinforcement member to said wooden structural element comprising securing one of each of said side plates to a respective one of said opposed sides of said structural element with the opening of each of said side plates disposed so as to surround said throughhole.

2. A method as claimed in claim 1 wherein said side plates each include a pattern of fastener apertures and said securing of said side plates to said wooden structural element comprises affixing said side plates to said opposed sides of said wooden structural element using a plurality of fasteners which penetrate into the wooden structural element through said fastener apertures so as to secure said reinforcement member in place on the wooden structural element.

3. A method according to claim 2 wherein said fasteners comprise mechanical fasteners selected from the group consisting of nails, screws and bolts.

4. A method according to claim 2 wherein said pattern of fastener apertures includes at least one row of apertures on each side of said opening.

5. A method according to claim 2 wherein the fastener apertures of said first plate are offset from the fastener apertures of said second plate.

6. A method according to claim 1 wherein said opening is of a trapezoidal shape.

7. A method for providing passage of an elongate infrastructure through a wooden structural element so that the infrastructure extends completely through the structural element, said method comprising:

providing a wooden structural element having opposed sides;

removing a portion of the wooden structural element so as to create a throughhole extending through the wooden structural element between said opposed sides; and reinforcing said wooden structural element using a reinforcement member comprising first and second spaced, parallel, reinforcing plates joined together at one edge thereof by a support plate and each having an opening therein larger than said throughhole, said support plate being of a thickness greater than that of the reinforcing plates and extending laterally outwardly of said reinforcing plates at opposite sides thereof;

said support plate being brought into abutment with a surface of said wooden structural element between said opposed sides and said reinforcing plates each being secured to one of said opposed sides of said structural element with the opening of each of said reinforcing plates disposed so as to surround said throughhole;

said reinforcing plates each including a pattern of fastener apertures and said securing of said reinforcing plates to said wooden structural element comprising affixing said reinforcing plates to said opposed sides of said wooden structural element using a plurality of fasteners which penetrate into the wooden structural element through said fastener apertures so as to secure said reinforcement member in place on the wooden structural element; and said method further comprising inserting an elongate infrastructure through said throughhole.

8. A method according to claim 7 wherein said fasteners comprise mechanical fasteners selected from the group consisting of nails, screws and bolts.

9. A method according to claim 7 wherein said pattern of fastener apertures includes at least one row of apertures on each side of said opening.

10. A method according to claim 7 wherein the fastener apertures of said first plate are offset from the fastener apertures of said second plate.

11. A method according to claim 7 wherein said opening is of a trapezoidal shape.

12. A method according to claim 7 wherein said elongate infrastructure comprises a pipe member.

13. A method according to claim 7 wherein said elongate infrastructure comprises a bundle of electrical cables.

* * * * *